US007466939B2

(12) United States Patent
Nakashima et al.

(10) Patent No.: US 7,466,939 B2
(45) Date of Patent: Dec. 16, 2008

(54) ELECTROPHOTOGRAPHIC IMAGE FORMING APPARATUS TO WHICH A PLURALITY OF PROCESS CARTRIDGES ARE DETACHABLY MOUNTABLE BY USING A MOVING GUIDE AND AN OPENING AND CLOSING MEMBER

(75) Inventors: Yoshiaki Nakashima, Shizuoka (JP); Takeshi Setoriyama, Shizuoka (JP); Shuji Nishitani, Shizuoka (JP); Hidetoshi Yamashita, Shizuoka (JP); Kazunari Murayama, Shizuoka (JP); Nobuharu Hoshi, Shizuoka (JP); Tatsuya Suzuki, Shizuoka (JP); Hideki Maeshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 11/437,684

(22) Filed: May 22, 2006

(65) Prior Publication Data

US 2006/0210304 A1 Sep. 21, 2006

Related U.S. Application Data

(62) Division of application No. 10/926,098, filed on Aug. 26, 2004, now Pat. No. 7,092,657.

(30) Foreign Application Priority Data

Aug. 29, 2003 (JP) ..... 2003-209841

(51) Int. Cl.
*G03G 21/16* (2006.01)
*G03G 15/00* (2006.01)
*G03G 21/00* (2006.01)

(52) U.S. Cl. ..... 399/111; 399/110; 399/121; 399/124

(58) Field of Classification Search ..... 399/110, 399/111, 114, 121, 124, 299, 302, 303, 308, 399/312
See application file for complete search history.

(56) References Cited

U.S. PATENT DOCUMENTS 6,453,135 B1 * 9/2002 Sameshima et al. ..... 399/110

(Continued)

FOREIGN PATENT DOCUMENTS

JP 62-226164 10/1987

(Continued)

*Primary Examiner*—Hoang Ngo
(74) *Attorney, Agent, or Firm*—Fitzpatrick, Cella, Harper & Scinto

(57) ABSTRACT

A plurality of process cartridges, each including an electrophotographic photosensitive drum, and a process device actable on the photosensitive drum, are detachably mountable to an electrophotographic image forming apparatus for forming an image of a recording medium. The image forming apparatus includes an opening and closing member; an intermediate transfer member or a recording medium bearing member provided in the opening and closing member such that the intermediate transfer member can face the process cartridges under a condition in which the opening and closing member is closed, and the intermediate transfer member can be separated from the process cartridges under a condition in which the opening and closing member is open; and a moving guide for holding the process cartridges. The moving guide is moved in interlocking relationship with a closing motion of the opening and closing member from a load position, to which the process cartridges are loaded, to a mount position, in which the process cartridges are capable of performing an image forming operation, such that the process cartridges mounted to the load position can be moved to the mount position.

15 Claims, 12 Drawing Sheets

U.S. PATENT DOCUMENTS

| | | | | |
|---|---|---|---|---|
| 6,522,845 | B2 | 2/2003 | Sameshima | 399/88 |
| 6,690,902 | B2 | 2/2004 | Noda et al. | 399/111 |
| 2002/0159790 | A1 | 10/2002 | Noda et al. | 399/111 |
| 2003/0147667 | A1 | 8/2003 | Arimitsu et al. | 399/111 |

FOREIGN PATENT DOCUMENTS

| | | |
|---|---|---|
| JP | 2-251872 | 10/1990 |
| JP | 3-84837 | 8/1991 |
| JP | 4-110177 | 4/1992 |
| JP | 4-333066 | 11/1992 |
| JP | 7-199568 | 8/1995 |
| JP | 8-278740 | 10/1996 |
| JP | 8-328448 | 12/1996 |
| JP | 2000-321843 | 11/2000 |
| JP | 2002-278418 | 9/2002 |
| JP | 2003-241466 | 8/2003 |
| JP | 2004-301899 | 10/2004 |
| JP | 2005-62274 | 3/2005 |

* cited by examiner

ELECTROPHOTOGRAPHIC IMAGE FORMING APPARATUS TO WHICH A PLURALITY OF PROCESS CARTRIDGES ARE DETACHABLY MOUNTABLE BY USING A MOVING GUIDE AND AN OPENING AND CLOSING MEMBER

This application is a divisional application of application Ser. No. 10/926,098, filed Aug. 26, 2004, allowed.

BACKGROUND OF THE INVENTION

1. Field of the Invention

The present invention relates to an electrophotographic image forming apparatus, and a process cartridge detachably mountable to a main body of an electrophotographic image forming apparatus.

An electrophotographic image forming apparatus discussed herein is an apparatus for forming an image on a recording medium using an electrophotographic image forming method. The electrophotographic image forming apparatus is exemplified by an electrophotographic copying machine, an electrophotographic printer (for example, a laser printer and an LED printer), a facsimile apparatus, a word processor, and a complex machine thereof (for example, a multi-function printer).

Further, a process cartridge discussed herein is a structure which is constructed by integrally assembling process means, such as charging means, developing means and cleaning means, and an electrophotographic photosensitive drum in the form of a cartridge, and which is adapted to be detachably mountable to a main body of an electrophotographic image forming apparatus. Alternatively, a process cartridge discussed herein is a structure that is constructed by integrally assembling at least one of charging means, developing means and cleaning means, which act as process means, and an electrophotographic photosensitive drum in the form of a cartridge, and is adapted to be detachably mountable to a main body of an electrophotographic image forming apparatus, or a cartridge that is constructed by integrally assembling at least developing means serving as process means, and an electrophotographic photosensitive drum in the form of a cartridge, and is adapted to be detachably mountable to a main body of an electrophotographic image forming apparatus.

2. Description of the Related Art

Conventionally, an electrophotographic image forming apparatus employs a process cartridge system in which an electrophotographic photosensitive drum (hereinafter also simply referred to as a photosensitive drum) and process means actable on the photosensitive drum are integrally assembled in the form of a cartridge that is detachably mountable to a main body of an electrophotographic image forming apparatus. According to such a process cartridge system, an operator or a user can carry out maintenance of the apparatus on his or her own without relying on a serviceman. Hence, operation capability or readiness of the apparatus can be drastically improved. Therefore, the process cartridge system is widely used in electrophotographic image forming apparatuses.

In an image forming apparatus of a cartridge system, it is conventionally known that a process cartridge is moved to an image forming position (a mount position), or a position in front of a main body of the apparatus (a load position), in interlocking relationship with an opening or closing motion of an opening and closing cover for opening or closing an opening of the main body of the apparatus (see United States Patent Application Publication No. U.S. 2002/0159790 A1, which has matured into U.S. Pat. No. 6,690,902). In a construction as disclosed in this U.S. patent, the cartridge is loaded (mounted) to a moving guide in front of the main body of the apparatus, and the moving guide guides the cartridge to the mount position in interlocking relationship with the motion of the cover when the cover is closed.

Accordingly, when the cartridge is mounted in the main body of the apparatus, the user need not push the cartridge into a deep inner portion of the main body of the apparatus. It is therefore possible to drastically improve the operation readiness of mounting a cartridge in a main body of an apparatus.

SUMMARY OF THE INVENTION

It is an object of the present invention to further improve the above-discussed related art, and to provide an electrophotographic image forming apparatus in a main body of which a process cartridge can be mounted with a preferable mounting operation readiness, and a process cartridge.

It is another object of the present invention to provide an electrophotographic image forming apparatus in a mount position in a main body of which a process cartridge can be mounted with an improved mounting operation readiness, and a process cartridge.

It is another object of the present invention to provide an electrophotographic image forming apparatus which is capable of accurately positioning a process cartridge in a main body of the apparatus, and a process cartridge.

It is another object of the present invention to provide an electrophotographic image forming apparatus which is capable of accurately achieving an electrical connection between a main body of the apparatus and a process cartridge, and a process cartridge.

It is another object of the present invention to provide an electrophotographic image forming apparatus which is capable of accurately moving a process cartridge to a mount position against a push-resistant force when the process cartridge is mounted in the mount position in a main body of the apparatus, and a process cartridge.

It is still another object of the present invention to provide a process cartridge detachably mountable to a main body of an electrophotographic image forming apparatus, which process cartridge includes an electrophotographic photosensitive drum, process means actable on the electrophotographic photosensitive drum, a cartridge frame for supporting the electrophotographic photosensitive drum and the process means, and a first electrical contact provided on the cartridge frame, and in which the first electrical contact is adapted to abut and be electrically connected to an electrical contact member provided on a moving guide movable from a load position, to which the process cartridge is loaded, to a mount position, in which the process cartridge is capable of performing an image forming operation, when the process cartridge is in the mount position.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Embodiments of the present invention will hereinafter be described with reference to the drawings. With respect to sizes, materials, shapes, relative positional relationships, and the like of structural components described in the following embodiments, the scope of the present invention is not limited to those described, unless described otherwise. Further, materials, shapes, and the like of portions or elements initially described in the following descriptions hold throughout these descriptions, unless newly described.

In the following descriptions, the longitudinal direction of a process cartridge is a direction which intersects (is substantially perpendicular to) a direction along which a process cartridge is mounted to or dismounted from a main body of an apparatus, and which is also a longitudinal direction of an electrophotographic photosensitive drum. Further, the top or upper surface of a process cartridge is a surface or side which takes an upper position when. the process cartridge is mounted in a main body of an apparatus, and the bottom or lower surface of a process cartridge is a surface or side which takes a lower position under such a condition.

(Description of an Overall Image Forming Apparatus)

Figure 2:
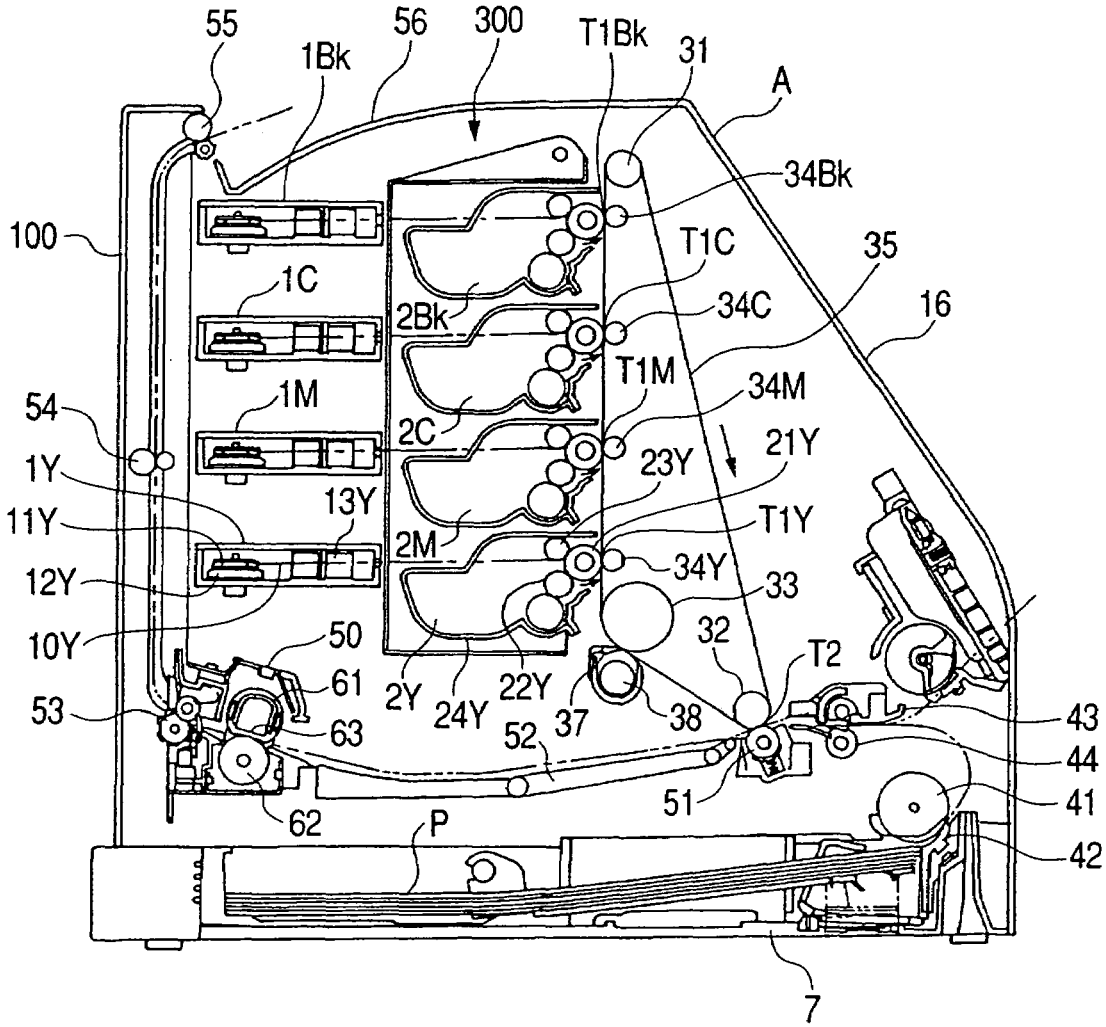
FIG. 2 is a schematic cross-sectional view illustrating a color laser printer which is an application of an embodiment of an image forming apparatus using an electrophotographic process.

An overall construction of a color electrophotographic image forming apparatus according to a first embodiment of the present invention will be described with reference to FIG. 2. FIG. 2 illustrates the entire structure of a color laser printer which is an application of the color electrophotographic image forming apparatus according to the first embodiment.

As illustrated in FIG. 2, the color laser printer (hereinafter also referred to as a printer simply) is a printer of 4-sequential-drum system (an in-line system) that includes four process cartridges 2 (2Y, 2M, 2C and 2Bk), an intermediate transfer member 35, a fixing portion 50 for fixing a color image transferred to a recording medium P (for example, a recording paper, an OHP sheet or the like), and pairs of discharging rollers 53, 54 and 55 for discharging the recording medium P onto a discharging tray 56 provided on an upper surface of the apparatus.

The four process cartridges 2 (2Y, 2M, 2C and 2Bk) are mounted in a manner of a perpendicular arrangement.

The cartridge 2Y accommodates a yellow developer, and forms a yellow-developer image. The cartridge 2M accommodates a magenta developer, and forms a magenta-developer image. The cartridge 2C accommodates a cyan developer, and forms a cyan-developer image. The cartridge 2Bk accommodates a black developer, and forms a black-developer image.

The developer images formed by the respective cartridges 2 are transferred to the intermediate transfer member 35 in a superimposed manner, and the intermediate transfer member 35 transfers the developer image (a color image) to the recording medium P.

The cartridges 2 of four colors are individually detachably mountable to a main body 100 of the apparatus (the printer).

Constructions of portions of the image forming apparatus will be described with reference to FIG. 2. In a case where the structure of each color cartridge is the same, description will be made only of the cartridge 2Y containing a yellow toner, and reference numerals or characters and descriptions of the other cartridges will be appropriately omitted.

(Electrophotographic Photosensitive Drum)

A photosensitive drum 21 (21Y) constitutes the cartridge 2 together and integrally with a photosensitive drum frame 24 (24Y). The cartridge 2 is supported by the main body 100 in a detachably mountable manner. The cartridge 2 can be readily replaced by another in accordance with a life of the photosensitive drum 21.

The photosensitive drum 21 in this embodiment is constructed by coating an outer circumferential surface of an aluminum cylinder with an organic photoconductive layer. The photosensitive drum 21 is rotatably supported by the photosensitive drum frame member 24 for accommodating the photosensitive drum 21. A driving force of a driving motor (not shown) is adapted to be transmitted to one end (a backward end in FIG. 2) of the photosensitive drum 21, so that the photosensitive drum 21 can be rotated in a counterclockwise direction (in FIG. 2) according to an image forming operation.

(Charging Means)

The charging means uses a contact-charging method. A roller-shaped conductive charging roller 23 (23Y) is caused to abut the surface of the photosensitive drum 21, and a voltage is applied to the charging roller 23. Thus, the surface of the photosensitive drum 21 is uniformly charged.

(Exposing Means)

Exposure of the photosensitive drum 21 is performed by a scanner portion 1 (1Y). Upon supply of an image signal to a laser diode (not shown), the diode emits an image light 10

(10Y) corresponding to the image signal, and a polygon mirror 11 (11Y) is irradiated with this light.

The polygon mirror 11 is rotated by a scanner motor 12 (12Y). The image light 10 reflected by the mirror 11 is guided to the surface of a rotating photosensitive drum 21 through an imaging lens 13 (13Y). The surface of the photosensitive drum 21 is selectively exposed by the image light 10. A latent image is thus formed on the photosensitive drum 21.

(Developing Means)

The developing means visualizes the latent image. A developing unit 2*b* (see FIG. 8) is provided to achieve development with a developer. The developing unit 2*b* includes a developing roller 22 (22Y). The developing roller 22 (22Y) is in contact with the photosensitive drum 21 while rotating. The latent image formed on the photosensitive drum 21 is thus developed with the developer.

(Intermediate Transfer Member)

The developer images on the photosensitive drums 21 developed by the respective developing units 2*b* are transferred to the intermediate transfer member 35 in a superimposed manner at the time of a color image forming operation. The intermediate transfer member 35 is therefore rotated in a clockwise direction (in FIG. 2) in synchronization with an outer circumferential speed of the photosensitive drum 21.

The developer images formed on the photosensitive drums 21 are transferred to the intermediate transfer member 35 in a superimposed manner by voltage-applied primary transferring rollers 34 (34Y, 34M, 34C and 34Bk) at primary transferring portions T1 (T1Y, T1M, T1C and T1Bk) which are contact points between the photosensitive drums 21 and the transferring rollers 34. The transferring roller 34 is arranged facing the photosensitive drum 21 to sandwich the intermediate transfer member 35 therebetween.

The intermediate transfer member 35 subjected to the superimposed transfer sandwiches the recording medium P at a secondary transferring portion T2 together with a voltage-applied secondary transferring roller 51. The recording medium P is thus conveyed by the intermediate transfer member 35 and the secondary transferring roller 51 such that the color developer images on the intermediate transfer member 35 can be simultaneously transferred to the recording medium P.

The intermediate transfer member (an intermediate transfer belt) 35 in this embodiment is comprised of a seamless resin belt having a circumferential length of about 620 mm. The intermediate transfer member 35 is stretched around three axes of a driving roller 31, a secondary transferring opposed roller 32 and a tension roller 33. Both opposite ends of the tension roller 33 are urged by springs. Accordingly, even if the circumferential length of the intermediate transfer member (belt) 35 changes due to variations of temperature and humidity in the main body 100 of the apparatus, or with time, the amount of this change can be absorbed.

The intermediate transfer member 35 is supported in the main body 100 of the apparatus with the driving roller 31 being a supporting point, and a driving force of a driving motor (not shown) is transmitted to one end (a backward end in FIG. 2) of the driving roller 31. The intermediate transfer member 35 is accordingly rotated in a clockwise direction (in FIG. 2) pursuant to the image forming operation.

(Feeding Portion)

The feeding portion supplies the recording medium P to the cartridge 2 mounted in the apparatus. The feeding portion includes a cassette 7 for accommodating a plurality of recording media P, a feeding roller 41, a separating pad 42, a feeding guide 43, and a pair of registration rollers 44.

At the time of forming an image, the roller 41 is rotated in accordance with the image forming operation. Each one sheet of the recording medium P is thus supplied from the feeding cassette 7. The thus-fed recording medium P is guided by the guide 43, and reaches the pair of registration rollers 44. The pair of registration rollers 44 carry out a non-rotating operation for achieving a standstill stand-by of the recording medium P and a rotating operation for feeding the recording medium P toward the intermediate transfer member 35 in a predetermined sequence. Positional alignment is thereby achieved between the image and the recording medium P during the transferring process at the following step.

(Transferring Portion)

The transferring portion has the secondary transferring roller 51 which is capable of swinging. The transferring roller 51 is movable in approximately up and down directions (in FIG. 2), and can be driven. The secondary transferring roller 51 is pressed against the intermediate transfer member 35 at a predetermined pressure by a cam member (not shown) with the recording medium P being sandwiched between the intermediate transfer member 35 and the secondary transferring roller 51, in synchronization with a timing for transferring the color images to the recording medium P. At this moment, a bias is applied to the transferring roller 51. The developer images on the intermediate transfer member 35 are thereby transferred to the recording medium P. Here, the intermediate transfer member 35 and the transferring roller 51 are driven, respectively. Accordingly, the recording medium P sandwiched between the intermediate transfer member 35 and the transferring roller 51 is fed in a left direction (in FIG. 2) after being subjected to the transferring process, and reaches the fixing device 50.

(Fixing Device)

The fixing device 50 fixes the color developer images to the recording medium P. The fixing device 50 includes a film guide unit 61 containing a ceramic heater 63 for applying heat to the recording medium P, and a pressing roller 62 for bringing the recording medium P into pressure-contact with the film guide unit 61. Heat and pressure are thus applied to the recording medium P. The color developer images are accordingly fixed to the recording medium P.

(Image Forming Operation)

The image forming operation by the thus-constructed apparatus will be described.

The feeding roller 41 (FIG. 2) is initially rotated. The recording medium P in the cassette 7 is accordingly fed out toward the pair of registration rollers 44.

On the other hand, the photosensitive drum 21 and the intermediate transfer member 35 are rotated in directions indicated by the arrows (FIG. 2) at a predetermined outer circumferential speed V (hereinafter also referred to as a process speed), respectively.

The photosensitive drum 21 with the surface charged by the charging roller 23 is subjected to exposure to the laser light (the image light) 10, and an electrostatic latent image is formed on the photosensitive drum 21. Image forming operations are common to the respective colors, and therefore, that of the yellow image will be described in the following.

(Formation of Yellow Image)

The photosensitive drum 21Y is irradiated with the yellow image light 10Y by the scanner portion 1Y, and a latent image corresponding to the yellow image is thus formed on the photosensitive drum 21Y. The developing roller 22Y is rotated simultaneously with that formation of the latent image. A voltage at the same polarity as a charged polarity of the photosensitive drum 21Y is applied to the developing roller 22Y such that the yellow developer can be attached to the latent image on the photosensitive drum 21Y. The development is thus carried out. The thus-developed yellow developer image is primarily transferred to the outer circumference of the intermediate transfer member 35 at the transferring portion T1Y by the transferring roller 34Y.

Formations of latent images and developments of yellow, magenta, cyan and black are performed in this order in the same manner as discussed above. The developer images are transferred to the intermediate transfer member 35 at the primary transferring portions T1Y, T1M, T1C and T1Bk, respectively. A full color image formed with four developers of yellow, magenta, cyan and black can be thus formed on the intermediate transfer member 35.

The recording medium P in the above-discussed stand-by state at the pair of registration rollers 44 begins to be fed prior to completion of transfer of the black developer to the intermediate transfer member 35.

At the time of forming the four color images on the intermediate transfer member 35, the transferring roller 51, which is so far in a lower stand-by position, and under a non-contact condition with the intermediate transfer member 35, is moved upward by a cam (not shown) simultaneously. The recording medium P is thus brought into pressure-contact with the intermediate transfer member 35 by the transferring roller 51 at the secondary transferring portion T2. A bias at a polarity opposite to that of the developer is applied to the transferring roller 51. Thus, the full color image of four colors on the intermediate transfer member 35 is simultaneously transferred to the recording medium P.

After that, the recording medium P is separated from the intermediate transfer member 35, and is fed to the fixing device 50 through conveying means 52. The developer image is then fixed. Thereafter, the recording medium P is discharged to the discharging tray 56 provided on the upper portion of the main body through the pairs of discharging rollers 53, 54 and 55. The image forming operation is thus completed.

(Process Cartridge Mounting Method)

Figure 1:
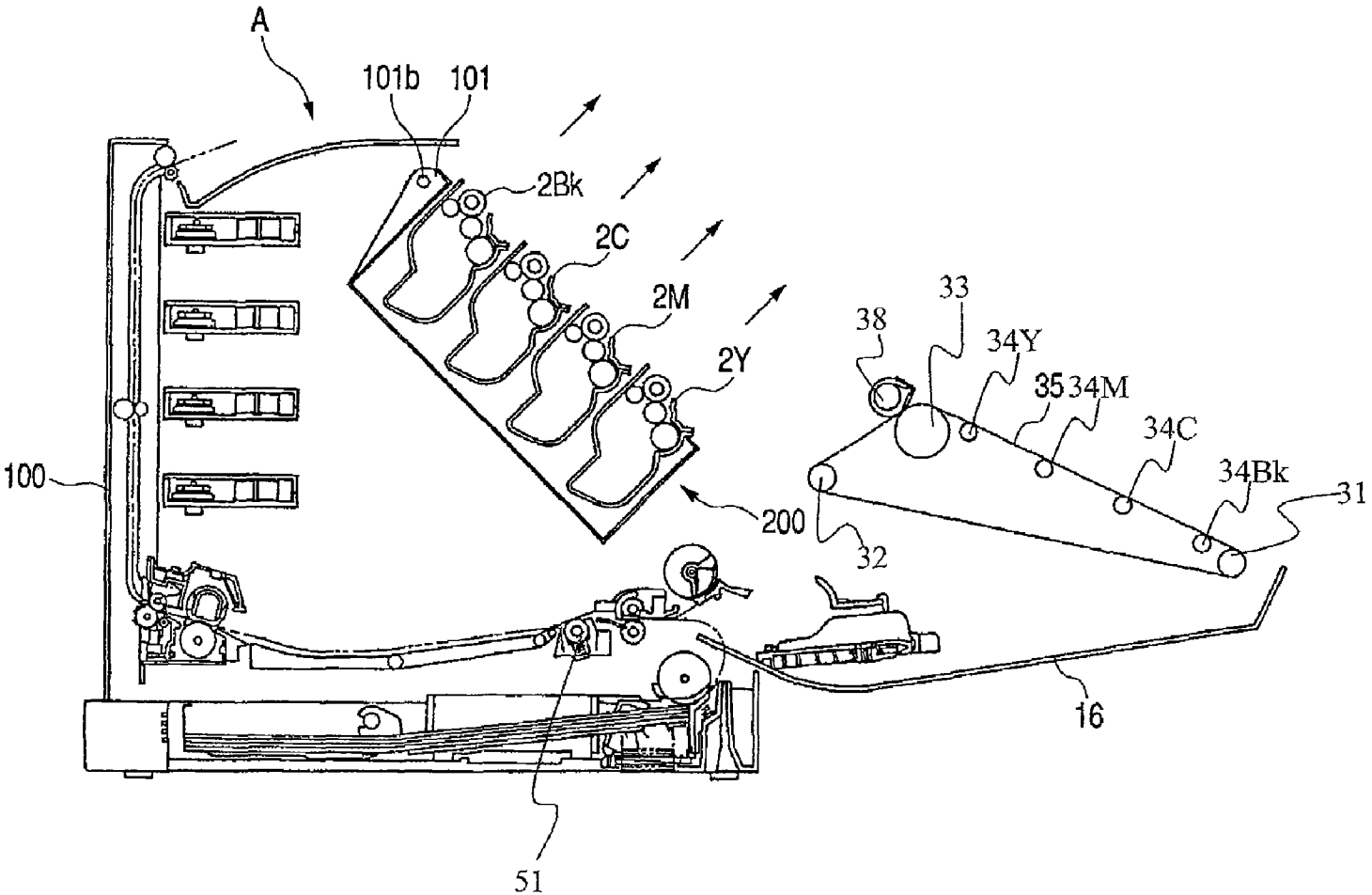
FIG. 1 is a schematic cross-sectional view illustrating a condition of an embodiment of an image forming apparatus according to the present invention, in which an opening and closing door is open.

Description will be made of the process cartridge 2, a mechanism for mounting the process cartridge 2, and the electrophotographic image forming apparatus according to the first embodiment. FIG. 1 is a cross-sectional view illustrating a condition in which an opening and closing door of a printer A (the image forming apparatus of this embodiment) is open.

As illustrated in FIG. 1, an opening and closing door 16 provided in a main body 100 of the apparatus has a rotational center on a front lower side of the image forming apparatus (printer) A. The above-discussed intermediate transfer member 35 is arranged on a side of the door 16. Therefore, the user can make access to the process cartridges 2 (2Y, 2M, 2C and 2Bk) when the door 16 is open.

The door 16 is opened or closed when the cartridge 2 is to be mounted to or dismounted from the main body 100.

A moving guide 101 holds a plurality of cartridges 2 (2Y, 2M, 2C and 2Bk) in the form of a unit. Pivot portions 101*a-b* and 101*b-b* (see FIG. 3) of the moving guide 101 are provided in an upper portion of the apparatus, and are coupled to the door 16 by a link mechanism (described later). Therefore, upon opening the door 16, the moving guide 101 is rotated about the pivot point, and moved toward the front side. Accordingly, the cartridges 2 supported by the moving guide 101 are also moved toward the front side.

In the first embodiment, a rotation angle at this moment is about 45 degrees.

In this state, the user loads (mounts) the cartridges 2 to the moving guide 101, or dismounts the cartridges 2 from the moving guide (supporting frame) 101. There is no obstacle along directions indicated by the arrows in FIG. 1, so that operation can be readily carried out.

Description will be made of the mounting and dismounting of the process cartridge 2 with respect to the main body 100 of the apparatus.

Figure 3:
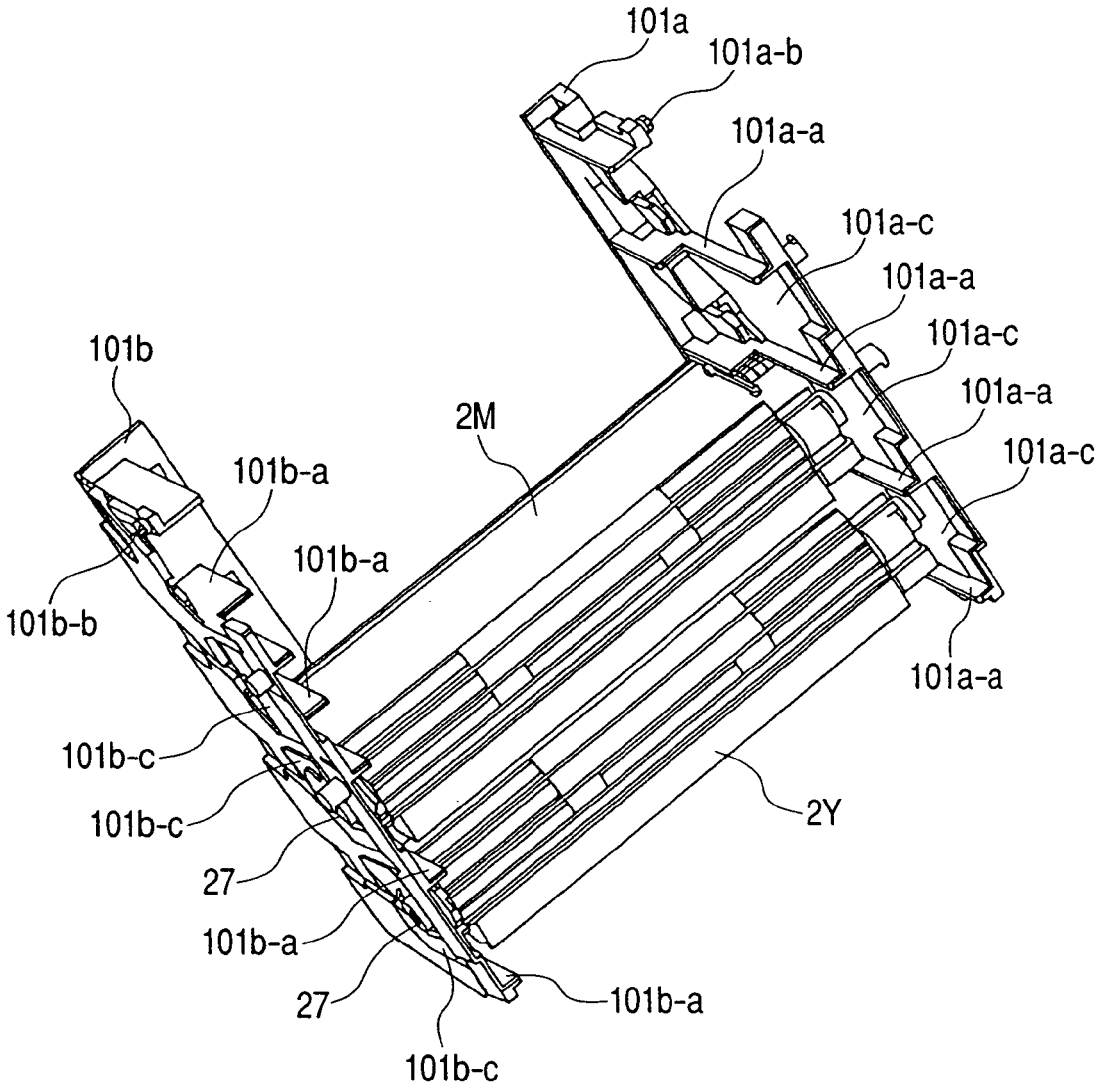
FIG. 3 is a schematic perspective view illustrating a condition in which an embodiment of a process cartridge is held by a moving guide.

FIG. 3 is a perspective view illustrating a condition under which the cartridges 2 are supported by the moving guide 101. The process cartridges 2Bk and 2C are not shown for the convenience of description.

The moving guide 101 has a right side plate 101*a* and a left side plate 101*b*. The right side plate 101*a* supports right sides of the cartridges 2Y, 2M, 2C and 2Bk. The left side plate 101*b* supports left sides of the cartridges 2Y, 2M, 2C and 2Bk. In this embodiment, the right side plate 101*a* and the left side plate 101*b* constituting the moving guide 101 are separately formed to reduce the cost. However, the moving guide 101 can be integrally formed, or can be constructed by coupling separate members.

In the moving guide 101 of this embodiment, the right side plate 101*a* and the left side plate 101*b* are coupled by a link member (described later). Hence, phases of the side plates 101*a* and 101*b* are also set to be approximately the same. The moving guide is thus constructed like the structure constructed in the form of a unit.

The right side plate 101*a* is provided with a guide rib 101*a-a*, and the left side plate 101*b* is provided with a guide rib 101*b-a*. Those ribs support a lower side of the cartridge 2 when the cartridge 2 is inserted into a space between the side plates 101*a* and 10*b*, so that the insertion can be smoothly achieved.

There are further provided pivot portions 101*a-b* and 101*b-b* that act as the rotational center when plural cartridges are assembled into a united structure.

An opening portion 101*a-c* is formed in the right side plate 101*a*. Therefore, there is no interference between the side plate 101*a* and a positioning bearing 28 of first and second driving-force transmitting portions 78 and 79 (see FIG. 10) through which the cartridge 2 receives the driving force from the main body 100 of the apparatus. Further, an opening 101*b-c* is formed in the left side plate 10*b*. Thereby, a positioning bearing 27 provided in the cartridge 2 does not interfere with the side plate 101*b*.

Bosses are further provided at two locations, respectively. The boss acts as a coupling portion with the link mechanism described later.

Description will be made of actual motions and the coupling of the moving guide 101 to the link mechanism.

Figure 4:
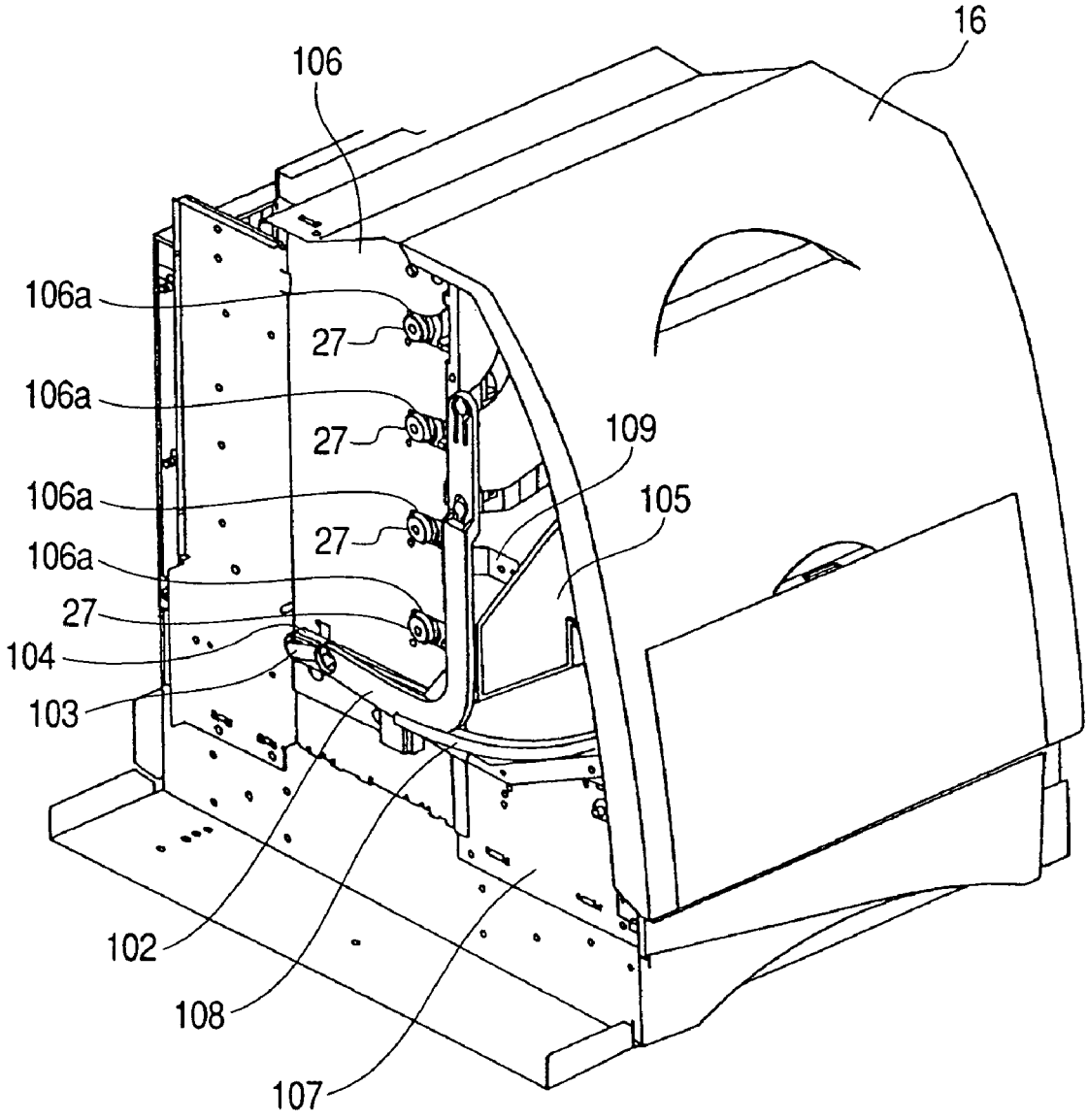
FIG. 4 is a schematic perspective view illustrating a condition of a link mechanism in a position at the time of an operating condition of an embodiment of an image forming apparatus according to the present invention.
Figure 5:
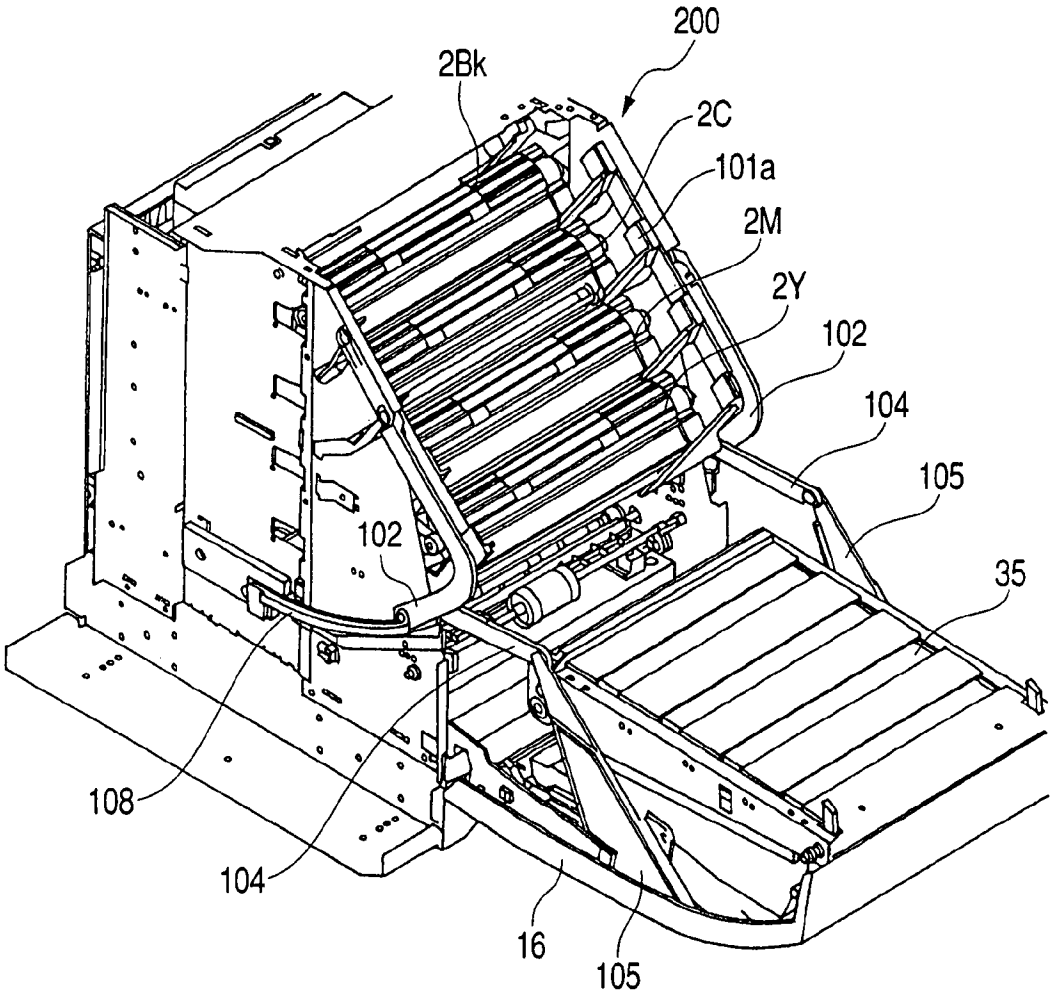
FIG. 5 is a schematic perspective view illustrating a condition of a link mechanism in a position at the time of an open condition of an opening and closing door in an embodiment of an image forming apparatus according to the present invention.
Figure 6:
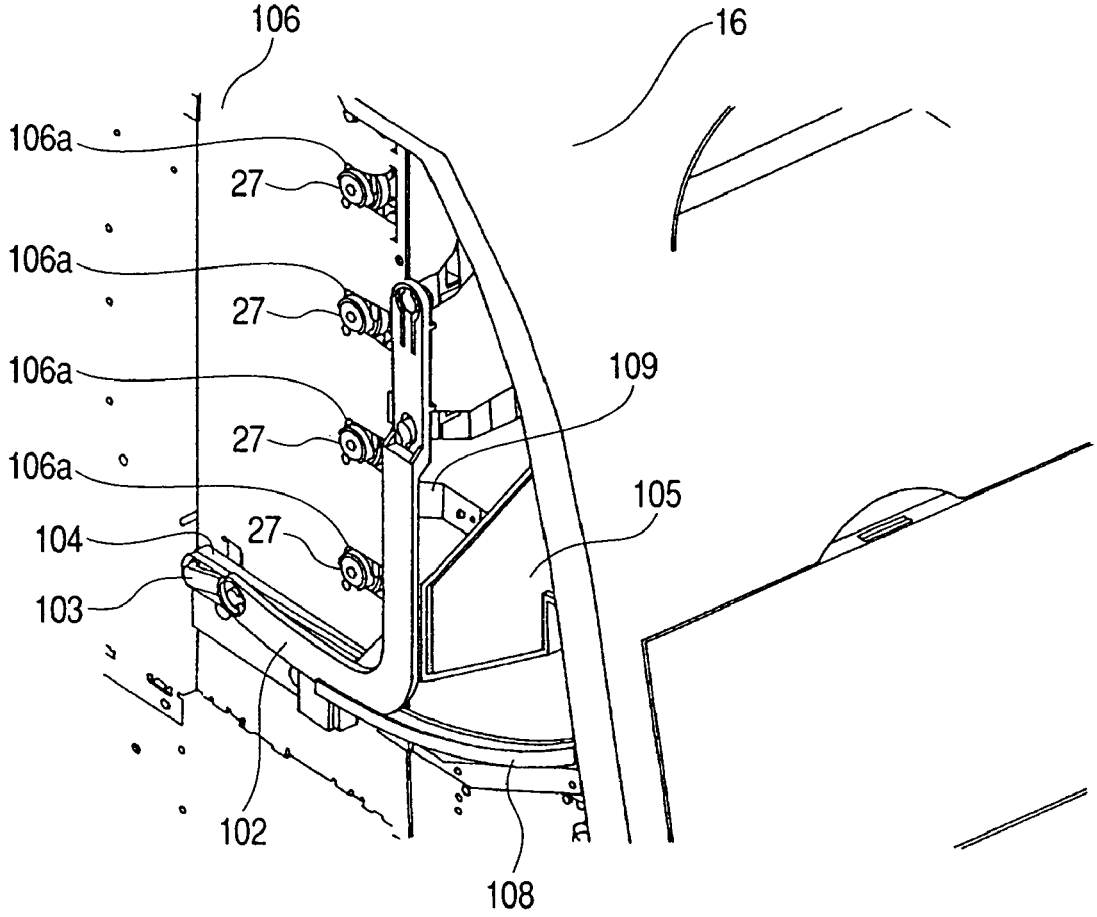
FIG. 6 is a partly-enlarged perspective view illustrating a condition of a link mechanism in a position at the time of an operating condition of an embodiment of an image forming apparatus according to the present invention.
Figure 7:
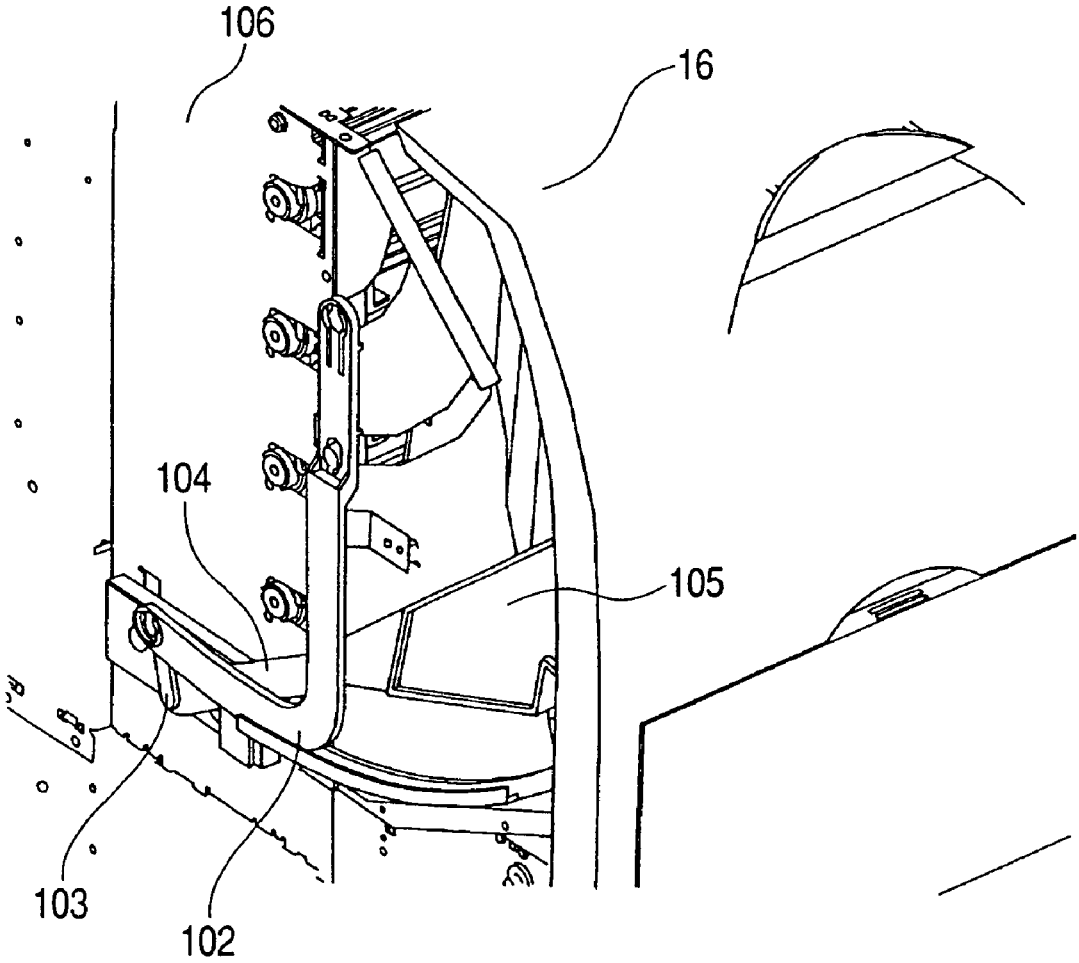
FIG. 7 is a schematic perspective view illustrating a condition of a link mechanism in a position at the time of an opening-starting condition of an opening and closing door in an embodiment of an image forming apparatus according to the present invention.

FIGS. 4, 5, 6 and 7 are schematic perspective views illustrating an inner portion of the apparatus and the link mechanisms coupling to the right side plate 101*a* and the left side plate 101*b*, respectively. FIG. 4 is a schematic perspective view illustrating a condition of the link mechanism in a position at the time of an operating condition of the image forming apparatus according to this embodiment. FIG. 5 is a schematic perspective view illustrating a condition of the link mechanism in a position at the time of an open condition of the opening and closing door of the image forming apparatus according to this embodiment. FIG. 6 is a partly-enlarged perspective view illustrating the condition of the link mechanism shown in FIG. 4. FIG. 7 is a schematic perspective view illustrating a condition of the link mechanism in a position at the time of an opening-starting condition of the opening and closing door of the image forming apparatus according to this embodiment.

A coupling rod 102 is a link member for coupling to the boss provided in the moving guide 101. An end portion of the coupling rod 102 on a side opposite to its coupling portion for coupling to the boss has an approximately-L-shape, and extends toward a rear portion of the main body 100 of the apparatus. This end portion is coupled to a rotation rod 103 such that a certain time lag can be set from the start of opening of the opening and closing door 16 till the start of motion of the moving guide 101.

An intermediate rod 104 is coupled to the rotation rod 103. A door coupling plate 105 provided integrally with the opening and closing door 16 is coupled to an end portion of the intermediate rod 104 on a side opposite to the coupling portion between the rotation rod 103 and the intermediate rod 104.

A central side plate 106 fixed to the main body 100 of the apparatus A is provided with positioning holes 106*a* formed corresponding to the cartridges 2 of respective colors, such that the cartridges 2 can be positioned.

A rod guide member 108 for guiding the coupling rod 102 is fixed to a front side plate 107 provided in the main body 100 of the apparatus A. The front side plate 107 is further provided with two holes formed at two locations to prevent interference with the boss serving as a coupling portion to the moving guide 101.

A holding spring 109 holds the moving guide 101 through the coupling rod 102 when the door 16 is closed.

Description will be made of a condition in which the door 16 is closed, referring to FIGS. 4 and 6. The moving guide 101 is pushed back toward a side of the main body 100 of the apparatus by the link mechanism coupled to the door 16, which is comprised of the door coupling plate 105, the intermediate rod 104, the rotation rod 103, and the coupling rod 102 coupled to the moving guide 101. The moving guide 101 is under a condition in which it is elastically urged by the holding spring 109.

In this state, each cartridge 2 is elastically urged by a spring (not shown) such that bearings 27 and 28 provided at both longitudinal opposite ends of the cartridge 2 are pressed against an end surface of the positioning hole 106*a* formed in the central side plate 106.

The apparatus is thus constructed such that the cartridge 2 can be positioned by not only the moving guide 101 but also the main body 100 of the apparatus A (i.e., the side plate 106 in the main body 100). Accordingly, when the cartridge 2 is to be loaded to the moving guide 101, the moving guide 101 acts only as a member for roughly guiding the cartridge 2. Therefore, the user can only roughly load (mount) the cartridge 2 to the moving guide 101. As a result, the user need not mount or load the cartridge 2 while confirming if it is accurately mounted or loaded, or not. The operation readiness can be hence improved.

Description will be made of a condition in which the door 16 begins to be opened, referring to FIG. 7. At the beginning of opening of the door 16, the link mechanism including the door coupling plate 105, the intermediate rod 104, and the rotation rod 103 is moved in interlocking relationship with the door 16. The rotation rod 103 is rotated about the coupling portion coupled to the coupling rod 102. Accordingly, the coupling rod 102 does not move until the rotation rod 103 takes an approximately horizontal position.

Under a condition in which the coupling rod 102 does not move, the drive transmitting means of the cartridge is disconnected by a driving cancellation mechanism (not shown) for the cartridge 2, which is interlocked with the motion of the opening and closing door 16 separately from the coupling rod 102.

After the drive transmitting means of the cartridge 2 is disconnected, the coupling rod 102 begins to move in interlocking relationship with the motion of the door 16. Therefore, the cartridge 2 can be smoothly moved to a load position 200 without any special operation by the user.

The load position 200 is located on a front side of the main body 100 of the apparatus A, and on a side where the door 16 is provided. Therefore, the user can load the cartridge 2 to the moving guide 101 on the front side of the main body 100 of the apparatus A.

Further, the user can unload the cartridge 2 from the moving guide 101.

The user need not insert a hand deep into the main body of the apparatus when the cartridge 2 is to be taken out from a mount position 300.

Accordingly, when the cartridge 2 is to be mounted in the mount position 300 of the main body 100 of the apparatus A, it is not necessary for the user to push the cartridge 2 deep into the main body 100 of the apparatus A.

Thus, mounting and dismounting readiness of the cartridge 2 can be improved. Here, the door 16 is opened or closed when the cartridge 2 is to be mounted to or dismounted from the main body 100 of the apparatus.

Due to the presence of the above-discussed link mechanism, a time delay for disconnecting the drive transmitting means of the cartridge 2 is created from the time the user begins to open the door 16 and the time the moving guide 101 begins to move. Therefore, at the time of a normal image forming operation, it is possible to accurately transmit the driving force as in conventional apparatuses. Further, it is also possible to move the cartridge 2 in interlocking relationship with the motion of the door 16.

Description will be made of a condition in which the door 16 is fully open, referring to FIG. 5. The moving guide 101 is moved to the load position 200, which forms an angle of about 45 degrees relative to the position at the image forming time, by the link mechanism coupled to the door 16 and including the door coupling plate 105, the intermediate rod 104, the rotation rod 103, and the coupling rod 102 (see FIG. 5). Due to such motion of the cartridge 2 to the load position 200, the user can readily make access to the cartridge 2, and it becomes easy to carry out the loading, mounting and dismounting.

The mount position 300 is a location whereat the cartridge 2 is positioned in the main body 100 of the apparatus A. Although the cartridge 2 slightly moves from this positioned location at the time of image formation, the mount position 300 includes those both locations.

In this embodiment, an intermediate transfer belt is used as a member facing the electrophotographic photosensitive drum. However, the intermediate transfer belt can be replaced by a conveying belt which bears transferring material. Also in this case, the same technical advantages can be obtained.

In this embodiment, the moving guide 101 for moving the cartridges in a united form is constructed so as to swing about the pivot provided in the upper portion of the main body 100 of the apparatus A. In the present invention, however, it is only necessary for the cartridge to be moved to a position on the front side of the main body 100 of the apparatus A, at which no obstacle, such as the intermediate transferring unit, is present, and which is a position permitting easy loading, mounting and dismounting of the cartridge. Therefore, the same technical advantages can be obtained even by a construction in which the cartridge is slid obliquely in an upward direction, for example.

Second Embodiment

Description will be made of characteristic portions of a process cartridge and an image forming apparatus according to a second embodiment. The same structures as those of the first embodiment will be appropriately omitted.

(Process Cartridge)

Figure 8:
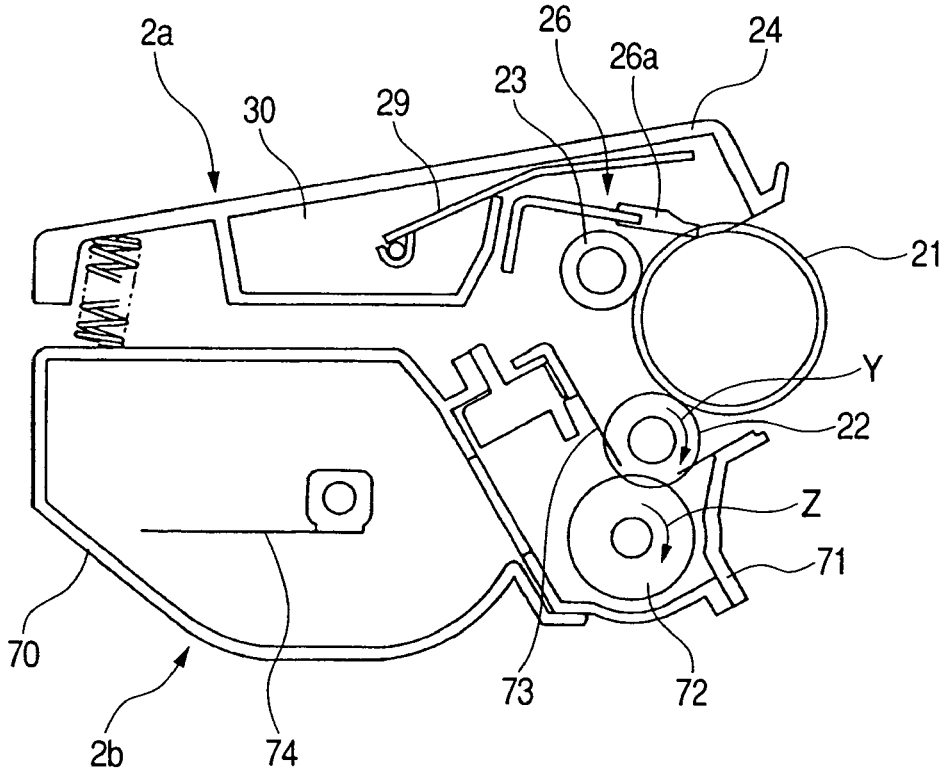
FIG. 8 is a schematic cross-sectional view illustrating an embodiment of a process cartridge according to the present invention.
Figure 9:
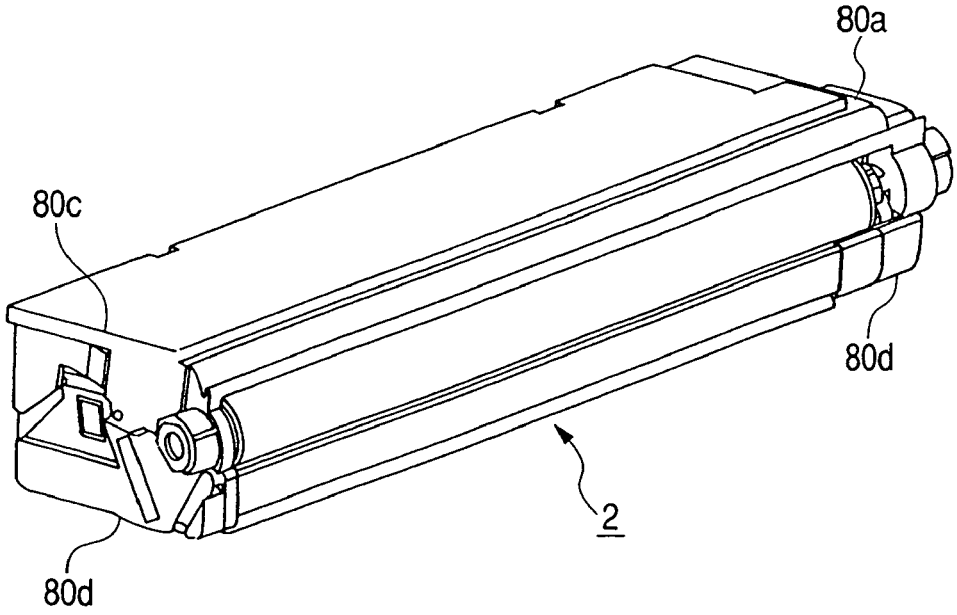
FIG. 9 is a schematic perspective view illustrating an embodiment of a process cartridge according to the present invention.
Figure 10:
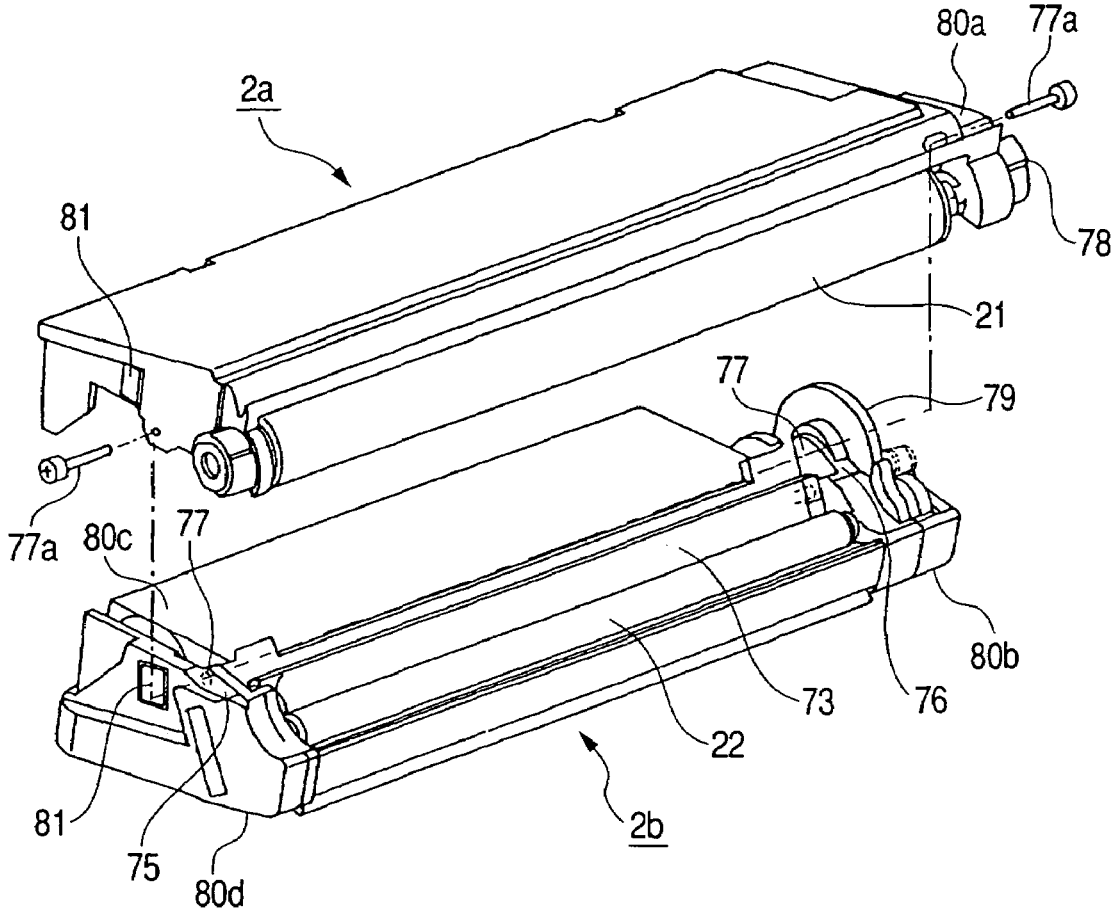
FIG. 10 is a schematic perspective view illustrating an embodiment of a process cartridge according to the present invention.

The above-discussed cartridge will be described with reference to FIGS. 8, 9 and 10. FIG. 8 is a cross-sectional view of the process cartridge, and FIGS. 9 and 10 are perspective views thereof, respectively. Constructions of yellow, magenta, cyan and black cartridges are the same as each other.

The cartridge 2 is divided into a drum unit 2*a* for supporting the photosensitive drum 21, the charging roller 23, and cleaning means 26, and a developing unit 2*b* for supporting developing means for developing an electrostatic latent image formed on the photosensitive drum 21.

Those units 2*a* and 2*b* are coupled to each other such that they can swing.

In the drum unit 2*a*, the photosensitive drum 21 is rotatably supported by a drum frame member 24 through bearings 27 and 28. In the drum frame member 24, there are further arranged the charging roller 23 for uniformly charging the surface of the photosensitive drum 21, which acts as process means, and a cleaning blade 26*a* for removing developer remaining on the surface of the photosensitive drum 21, which acts as process means.

Residual toner removed from the surface of the photosensitive drum 21 by the cleaning blade 26*a* is supplied to a removed-toner chamber 30, which is provided in a rear portion of the drum frame member 24, by a toner carrying mechanism 29. The toner chamber 30 is also provided in the drum unit 2*a*.

The developing unit 2*b* includes the developing roller 22 rotated in a direction indicated by the arrow Y while being in contact with the photosensitive drum 21, which acts as process means, a developer container 70 for accommodating developer, and a developing frame member 71 for supporting these members. The developing roller 22 is rotatably supported by the developing frame member 71 through bearing members. The developing frame member 71 is further provided with a developer supplying roller 72 rotated in a direction indicated by the arrow Z while being in contact with the developing roller 22, and a developing blade 73. Further, there is provided in the developer container 70 an agitating member 74 for agitating the developer in the container 70 and carrying it to the supplying roller 72.

The entire developing unit 2*b* is coupled to the drum unit 2*a* by pins 77*a* rotatably about holes 77 formed in bearing members 75 and 76 mounted to both longitudinal opposite ends of the developing unit 2*b*. Thus, a swinging structure is constructed. Accordingly, in the cartridge 2 itself (not mounted in the main body), the developing roller 22 is brought into contact with the photosensitive drum 21 by a rotating moment about the holes 77. Further, the developing unit 2*b* is always resiliently urged to the photosensitive drum unit 2*a* by a compression spring.

The cartridge frame member includes the drum frame member 24 and the developing frame member 71.

During the developing operation, developer is carried to the supplying roller 72 by the agitating member 74. The supplying roller 72 rotating in the direction indicated by the arrow Z supplies the developer to the developing roller 22 by sliding friction between the rotating supplying roller 72 and the developing roller 22 rotating in the direction indicated by the arrow Y. The developer is thus carried on the circumferential surface of the developing roller 22. The developer carried on the circumferential surface of the developing roller 22 reaches the developing blade 73 as the developing roller 22 rotates. The developing blade 73 regulates the developer and gives it a desired amount of charged charges. Thus, a developer layer having a predetermined thickness is formed on the circumferential surface of the developing roller 22.

The developer is carried to the developing portion, in which the photosensitive drum 21 is in contact with the developing roller 22, as the developing roller 22 rotates. In the developing portion, development is executed by a DC developing bias applied to the developing roller 22 from an electrical power source (not shown). On the other hand, developer remaining on the surface of the developing roller 22 is removed from the circumferential surface of the developing roller 22, and collected. The thus-collected developer is agitated, and is mixed with remaining developer by the agitating member 74.

(Electrical Connection Structure Between Main Body of Image Forming Apparatus and Process Cartridge)

Figure 11:
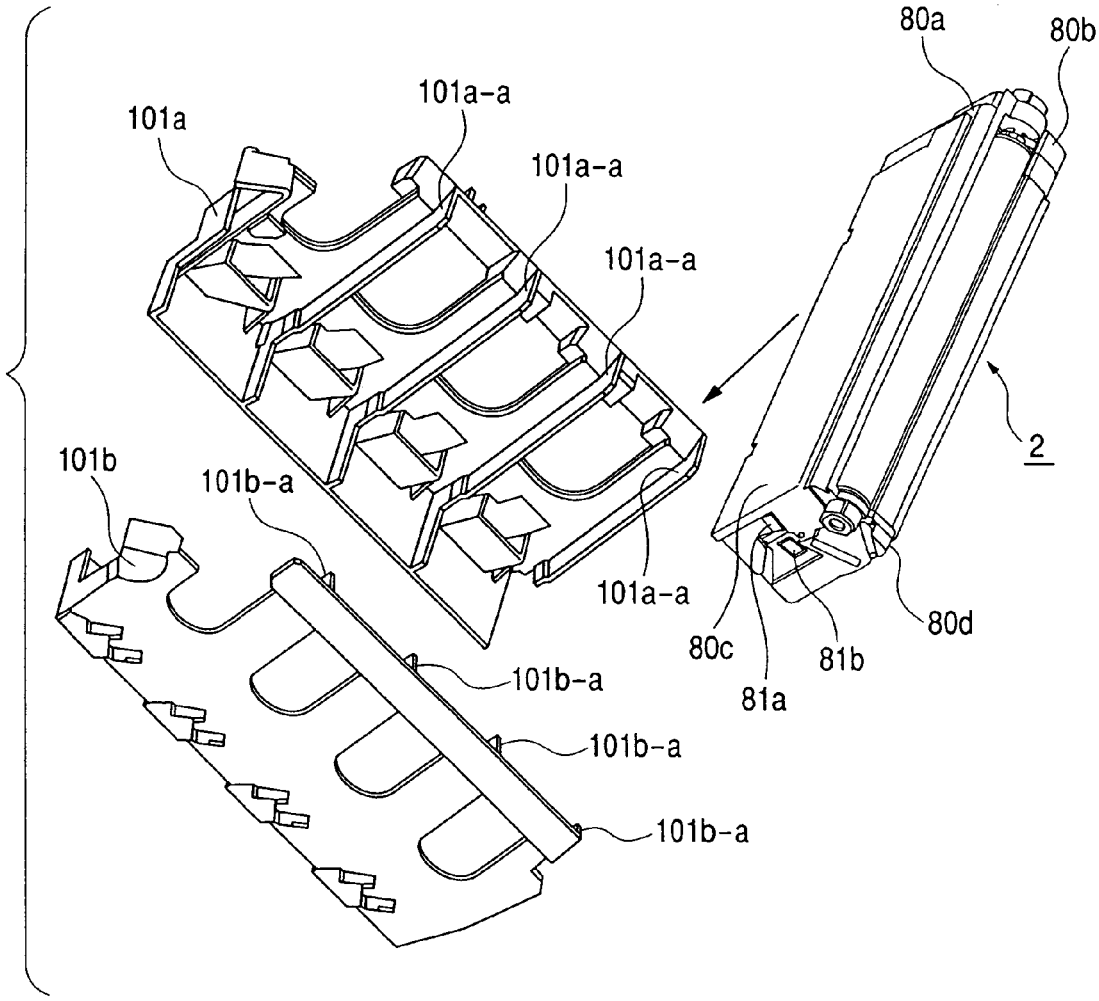
FIG. 11 is a schematic perspective view illustrating a condition in which an embodiment of a process cartridge is to be mounted to a moving guide.
Figure 12:
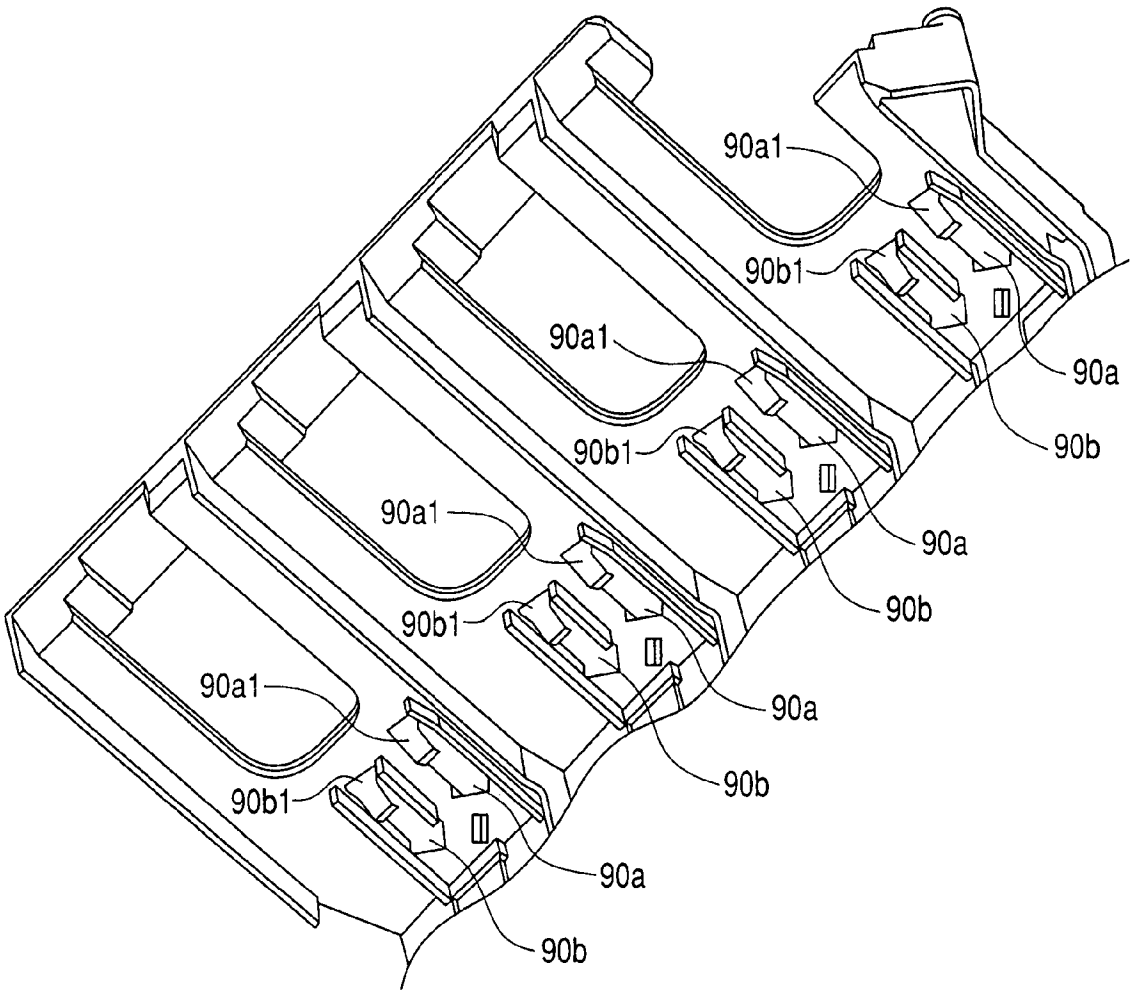
FIG. 12 is a partial perspective view illustrating a left side plate of a moving guide according to an embodiment, viewed from an upper right side.
Figure 13:
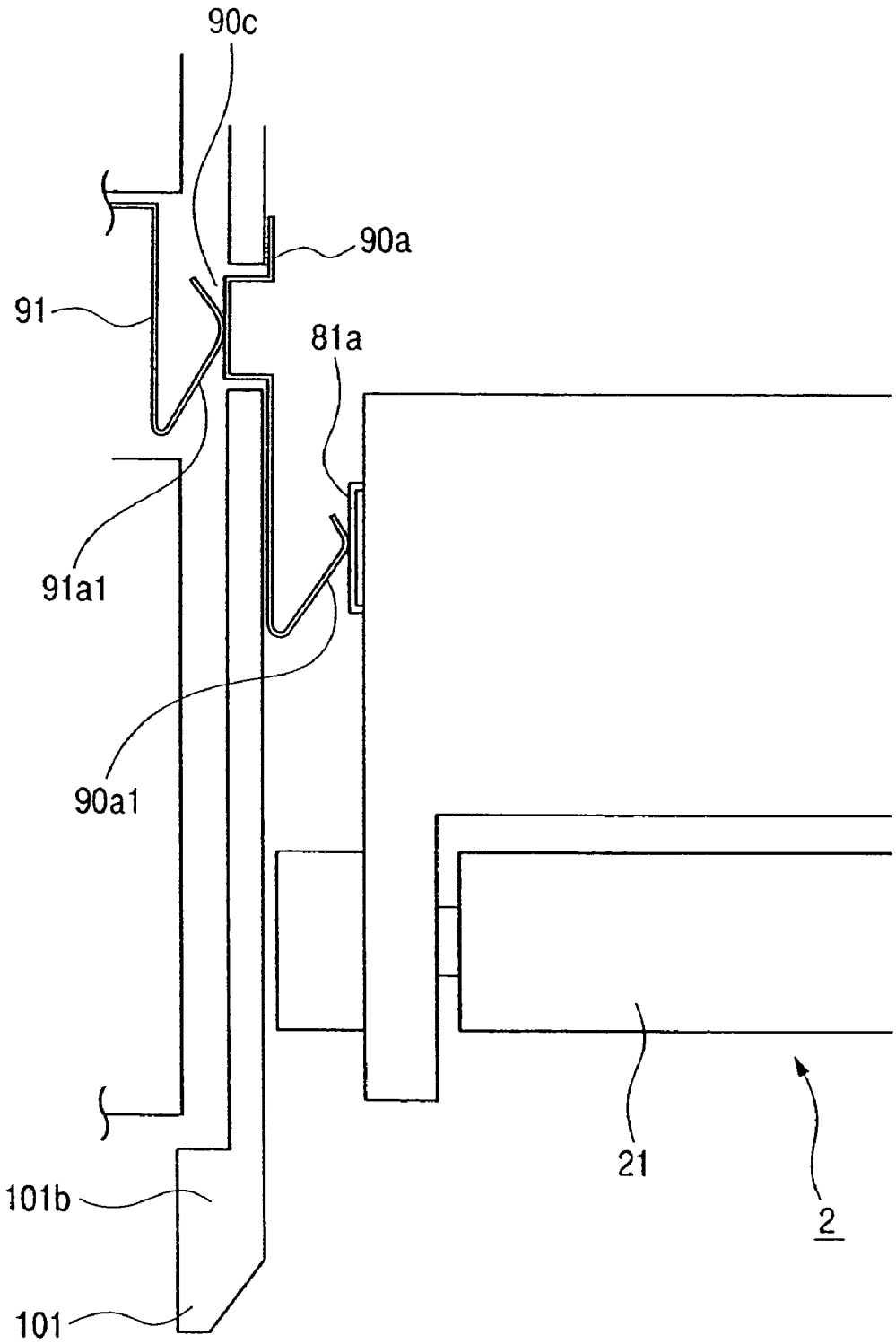
FIG. 13 is a partial cross-sectional view illustrating an electrical contact structure between a main body of a printer and a process cartridge according to a second embodiment.

Description will be made of an electrical connection structure between the image forming apparatus and the process cartridge according to the second embodiment, referring to FIGS. 11, 12 and 13. FIG. 11 is a schematic perspective view illustrating a condition in which the process cartridge is to be loaded to the moving guide. FIG. 12 is a partial perspective view illustrating the left side plate of the moving guide viewed from an upper right side. FIG. 13 is a partial cross-sectional view illustrating an electrical contact structure between the image forming apparatus and the process cartridge.

The cartridge 2 is provided with first electrical contacts 81 (81*a* and 81*b*) on a left side surface (a side surface of the cartridge 2 in its longitudinal direction). The first electrical contact 81*a* is a contact for applying a predetermined charging bias to the charging roller 23. The first electrical contact 81*b* is an electrical contact for applying a predetermined developing bias to the developing roller 22. The left side plate 101*b* of the moving guide 101 provided in the main body 100 of the apparatus A is provided with an intermediate electrical contact 90 with which the first electrical contact 81 provided on the cartridge 2 is brought into contact when the cartridge 2 is loaded (mounted) to the moving guide 101.

The intermediate electrical contacts 90 (90*a* and 90*b*) are electrical contact members for establishing electrical connections between the first electrical contacts 81 (81*a* and 81*b*) and second electrical contacts 91 provided in the main body 100 of the apparatus A, respectively. In the second embodiment, a thin metal plate in the form of a leaf spring is used as the intermediate electrical contact 90. An intermediate contact member in the form of a wire spring or a pin can also be used.

When the cartridge 2 is mounted along a guide portion of the moving guide 101, the first electrical contact 81 a provided on the cartridge 2 abuts a first contact face 90*a*1 (on the cartridge side) of the intermediate electrical contact 90*a* provided on the left side plate 101*b*. Thus, the first electrical contact 81*a* is electrically connected to the first electrical contact 90*a*. Similarly, the first electrical contact 81*b* abuts a first electrical contact face 90*b*1, and hence the first electrical contact 81*b* is electrically connected to the intermediate electrical contact 90*b*.

Upon closing the door 16, the cartridge 2 is rotated together with the moving guide 101, and is moved to the mount position 300 whereat the image formation is possible. A contact face 90*c* (on the side of the main body of the apparatus) of the intermediate electrical contact 90 (90*a* or 90*b*) provided on the left side plate 101*b* accordingly abuts a third electrical contact face 91*a*1 of the second electrical contact 91 fixedly provided on the main body 100 of the apparatus A.

The first electrical contact 81*a* is electrically connected to the second electrical contact 91 through the intermediate electrical contact 90*a*.

Though not illustrated in FIG. 13, the first electrical contact 81*b* similarly abuts a third electrical contact face (not shown) of the second electrical contact (not shown) fixedly provided on the main body 100 of the apparatus A, through the intermediate electrical contact 90*b*.

In other words, a structure for electrically connecting the first electrical contact 81*b* to the second electrical contact is the same as the structure illustrated in FIG. 13, and its illustration is accordingly omitted. Thus, the first electrical contact 81*b* is also electrically connected to the second electrical contact (not shown) through the intermediate electrical contact 90*b*.

Though not illustrated in FIG. 13, the second electrical contact 91 is electrically connected to an electrical power source (not shown) provided in the main body 100 of the apparatus A.

Due to the presence of the above-discussed intermediate electrical contacts 90*a* and 90*b*, the first electrical contacts 81 for the respective colors can have the same electrical contact structure, irrespective of a difference in rotation loci of the respective color cartridge stations formed when each station is moved from the load position 200, in which the cartridge 2 is loaded to the moving guide 101, to the mount position 300, in which the image formation is possible, by the rotation or swing of the moving guide 101.

Therefore, positions and shapes of the first electrical contacts 81 provided in the respective color cartridges 2 can be the same as each other, respectively. The cost can be reduced due to improvement of assemblage readiness of each color process cartridge and common use of components. In other words, structures of the electrical contacts in the respective color cartridges 2T, 2M, 2C and 2Bk can be the same as each other.

Further, due to the above-discussed electrical contact structure, the cartridge 2 positioned in the mount position 300 can receive a bias from the main body 100 of the apparatus A notwithstanding the movement of the cartridge 2 from the load position 200 to the mount position 300 by the moving guide 101.

Further, the above-discussed contact provided in the main body 100 of the printer can achieve a more stable electrical connection than a structure in which the contact directly abuts a contact provided in the cartridge 2 penetrating the left side 101*b*. The reason for this is that there is no need to simultaneously consider both of a tolerance at the time when the cartridge 2 is loaded to the moving guide 101 and an assemblage tolerance of the moving guide 101 in the main body 100 of the printer A. Accordingly, no high precision is necessary for shapes and arrangements of the first electrical contact 81, the second electrical contact 91 and the intermediate electrical contact 90, and it is hence possible to improve the assemblage readiness and reduce the manufacturing cost of components.

Further, due to the presence of the intermediate electrical contact 90, the first electrical contact 81 and the second electrical contact 91 are not necessarily located close to each other. Accordingly, layout flexibility increases, and designing becomes easy to perform. Specifically, the first electrical contact 81 can be provided on a back side of the main body 100 of the apparatus A. Accordingly, there is almost no influence of the difference in the rotation loci of the respective stations in the moving guide 101. In other words, the intermediate electrical contact 90 provided in each station abuts the second electrical contact 91, which is provided in the main body 100 of the apparatus A, under a substantially horizontal condition.

Furthermore, when the cartridge 2 is moved to the mount position 300 for the image formation by dint of the movement of the moving guide 101, the first electrical contact 81 never abuts the second electrical contact 91 directly. Therefore, the cartridge 2 is never pushed back toward the side of the door 16. Only a small pressing force is needed to move the cartridge 2 to the mount position 300. Thus, mounting readiness of the cartridge 2 in the main body 100 of the apparatus A is improved.

Summaries of the above-discussed embodiments are as follows.

There is provided an electrophotographic image forming apparatus A to which a plurality of process cartridges 2 are detachably mountable for forming an image on a recording medium P, the plurality of process cartridges 2 each including an electrophotographic photosensitive drum 21, and process means (for example, a developing roller 22 and a charging roller 23) actable on the electrophotographic photosensitive drum, which electrophotographic image forming apparatus A includes an opening and closing member (an opening and closing door 16), an intermediate transfer member 35 or a recording medium bearing member provided in the opening and closing member (the opening and closing door 16) such that the intermediate transfer member can face the process cartridges under a condition in which the opening and closing member is closed, and the intermediate transfer member can be separated from the process cartridges under a condition in which the opening and closing member is open, and a moving guide 101 for holding the process cartridges, which is movable in interlocking relationship with a closing motion of the opening and closing member (the opening and closing door 16) from a load position 200, to which the process cartridges are loaded, to a mount position 300, in which the process cartridges are capable of performing an image forming operation, such that the process cartridges 2 loaded in the load position 200 can be moved to the mount position 300.

Further, there is provided an electrophotographic image forming apparatus A which includes an intermediate transfer member 35 or a recording medium bearing member provided in an opening and closing member (an opening and closing door 16) such that the intermediate transfer member can face a plurality of process cartridges 2 under a condition in which the opening and closing member is closed, and the intermediate transfer member can be separated from the process cartridges 2 under a condition in which the opening and closing member is open.

Further, there is provided an electrophotographic image forming apparatus A in which a link mechanism (a coupling rod 102, a rotation rod 103, an intermediate rod 104, and a door coupling plate 105) for moving a moving guide 101 in interlocking relationship with a motion of an opening and closing member (an opening and closing door 16) is constructed such that when the opening and closing member (the opening and closing door 16) is opened from its closed state, the opening and closing member moves a predetermined amount, and the moving guide 101 then begins to move.

Further, there is provided an electrophotographic image forming apparatus A which is provided with a driving cancellation mechanism for disconnecting drive transmitting means for transmitting drive to a photosensitive drum 21 and process means while an opening and closing member (an opening and closing door 16) moves a predetermined amount.

Further, there is provided an electrophotographic image forming apparatus A in which a positioning member (a positioning hole 106*a*) for positioning a process cartridge 2 relative to a main body of the electrophotographic image forming apparatus A is fixed to the main body 100.

Further, there is provided an electrophotographic image forming apparatus A in which a moving guide 101 includes an electrical contact member (an intermediate electrical contact 90) for electrically connecting a first electrical contact 81 provided in a process cartridge 2 to a second electrical contact 91 provided in a main body of the apparatus (a printer A).

Further, there is provided an electrophotographic image forming apparatus A in which an electrical contact member (an intermediate electrical contact 90) includes a first contact face 90*a*1 for abutting a first electrical contact 81 provided in a process cartridge 2 in a load position 200, and a second contact face 90*c* for abutting a second electrical contact 91 provided in a main body 100 of the apparatus when the process cartridge 2 is moved to a mount position 300.

Furthermore, there is provided a process cartridge 2 detachably mountable to a main body of an electrophotographic image forming apparatus A, which includes an electrophotographic photosensitive drum 21, process means (for example, a developing roller 22 and a charging roller 23) actable on the electrophotographic photosensitive drum, a cartridge frame (for example, a photosensitive drum frame member 24 and a developing frame member 71) for supporting the electrophotographic photosensitive drum and the process means, and a first electrical contact 81 provided on the cartridge frame, and in which the first electrical contact is adapted to abut and be electrically connected to an electrical contact member (an intermediate contact 90) provided on a moving guide 101 for guiding the process cartridge from a load position 200, to which the process cartridge is loaded, to a mount position 300, in which the process cartridges 2 are capable of performing an image forming operation, when the process cartridge is in the load position 200.

As described above, according to the invention, the mounting operability of the process cartridge to the main body of the electrophotographic image forming apparatus can be improved.

While the invention has been described with reference to the structure disclosed herein, it is not confined to the details set forth and this application is intended to cover such modifications or changes as may come within the purposes of the improvements or the scope of the following claims.

This application claims priority from Japanese Patent Application No. 2003-209841 filed Aug. 29, 2003, which is hereby incorporated by reference herein.

What is claimed is:

1. An electrophotographic image forming apparatus to which a plurality of process cartridges are detachably mountable for forming an image on a recording medium, the plurality of process cartridges each including an electrophotographic photosensitive drum, and process means actable on the electrophotographic photosensitive drum, said electrophotographic image forming apparatus comprising:

an opening and closing member openable and closable with respect to a main body of said electrophotographic image forming apparatus, said opening and closing member being rotated to an outside of one side of the main body of said apparatus with a lower portion of the main body of said apparatus acting as a rotation axis to open the main body of said apparatus;

a moving guide for holding the plurality of process cartridges so that the plurality of process cartridges are vertically arranged, said moving guide being rotated, with an upper portion of the main body of said apparatus acting as a rotation axis, in interlocking relationship with a closing motion of said opening and closing member from a load position, in which the plurality of process cartridges are loaded, to a mount position, in which the plurality of process cartridges can perform an image forming operation, such that the plurality of process cartridges loaded in the load position are moved to the mount position, and said moving guide being constructed such that when said opening and closing member is opened from a closed state in which said opening and closing member is closed, said moving guide begins to move in interlocking relationship with an opening motion of said opening and closing member after said opening and closing member moves a predetermined amount, and said moving guide is rotated toward the one side of the main body of said apparatus in interlocking relationship with the opening motion of said opening and closing member to move the plurality of process cartridges held by said moving guide to the load position; and an intermediate transfer belt provided in said opening and closing member such that said intermediate transfer belt is opposed to electrophotographic photosensitive drums respectively provided in the plurality of process cartridges held by said moving guide in a closed state in which said opening and closing member is closed, and said intermediate transfer belt is separated from the plurality of process cartridges to a position in which said intermediate transfer belt poses no obstacle to mounting and detaching of the plurality of process cartridges in an open state in which said opening and closing member is opened, and such that developer images respectively formed on the electrophotographic photosensitive drums are transferred to said intermediate transfer belt in a superimposed manner, and the developer images transferred in the superimposed manner are collectively transferred from said intermediate transfer belt to the recording medium, wherein when the plurality of process cartridges are detached from said moving guide, the plurality of process cartridges are detached upward through the one side of the main body.

2. An electrophotographic image forming apparatus according to claim 1, further comprising a driving cancellation mechanism for disconnecting drive transmitting means for transmitting drive to the photosensitive drum and to the process means, while said opening and closing member moves the predetermined amount.

3. An electrophotographic image forming apparatus according to claim 1, wherein positioning members for positioning the plurality of process cartridges relative to the main body of said apparatus are fixed to the main body of said apparatus.

4. An electrophotographic image forming apparatus according to claim 1, wherein said moving guide comprises an electrical contact member for electrically connecting a first electrical contact provided in each of the plurality of process cartridges to a second electrical contact provided in the main body of said apparatus.

5. An electrophotographic image forming apparatus according to claim 4, wherein said electrical contact member comprises a first electrical contact face for abutting the first electrical contact provided in each of the plurality of process cartridges held by said moving guide, and a second electrical contact face for abutting the second electrical contact provided in the main body of said apparatus when each of the plurality of process cartridges is moved to the mount position.

6. An electrophotographic image forming apparatus to which a plurality of process cartridges are detachably mountable for forming an image on a recording medium, the plurality of process cartridges each including an electrophotographic photosensitive drum, and process means actable on the electrophotographic photosensitive drum, said electrophotographic image forming apparatus comprising:

an opening and closing member openable and closable with respect to a main body of said electrophotographic image forming apparatus, said opening and closing member being rotated to an outside of one side of the main body of said apparatus with a lower portion of the main body of said apparatus acting as a rotation axis to open the main body of said apparatus; and a moving guide for holding the plurality of process cartridges so that the plurality of process cartridges are vertically arranged, said moving guide being rotated, with an upper portion of the main body of said apparatus acting as a rotation axis, in interlocking relationship with a closing motion of said opening and closing member from a load position, in which the plurality of process cartridges are loaded, to a mount position, in which the plurality of process cartridges can perform an image forming operation, such that the plurality of process cartridges loaded in the load position are moved to the mount position, and said moving guide being constructed such that when said opening and closing member is opened from a closed state in which said opening and closing member is closed, said moving guide begins to move in interlocking relationship with an opening motion of said opening and closing member after said opening and closing member moves a predetermined amount, and said moving guide is rotated toward the one side of the main body of said apparatus in interlocking relationship with the opening motion of said opening and closing member to move the plurality of process cartridges held by said moving guide to the load position, wherein when the plurality of process cartridges are detached from said moving guide, the plurality of process cartridges are detached upward through the one side of the main body.

7. An electrophotographic image forming apparatus according to claim 6, further comprising a driving cancellation mechanism for disconnecting drive transmitting means for transmitting drive to the photosensitive drum and to the process means, while said opening and closing member moves the predetermined amount.

8. An electrophotographic image forming apparatus according to claim 6, wherein positioning members for positioning the plurality of process cartridges relative to the main body of said apparatus are fixed to the main body of said apparatus.

9. An electrophotographic image forming apparatus according to claim 6, wherein said moving guide comprises an electrical contact member for electrically connecting a first electrical contact provided in each of the plurality of process cartridges to a second electrical contact provided in the main body of said apparatus.

10. An electrophotographic image forming apparatus according to claim 9, wherein said electrical contact member comprises a first electrical contact face for abutting the first electrical contact provided in each of the plurality of process cartridges held by said moving guide, and a second electrical contact face for abutting the second electrical contact provided in the main body of said apparatus when each of the plurality of process cartridges are moved to the mount position.

11. An electrophotographic image forming apparatus to which a plurality of process cartridges are detachably mountable for forming an image on a recording medium, the plurality of process cartridges each including an electrophotographic photosensitive drum, and process means actable on the electrophotographic photosensitive drum, said electrophotographic image forming apparatus comprising:

an opening and closing member openable and closable with respect to a main body of said electrophotographic image forming apparatus, said opening and closing member being rotated to an outside of one side of the main body of said apparatus with a lower portion of the main body of said apparatus acting as a rotation axis to open the main body of said apparatus; and a moving guide for holding the plurality of process cartridges so that the plurality of process cartridges are vertically arranged, said moving guide being rotated about a rotation axis in interlocking relationship with a closing motion of said opening and closing member from a load position, in which the plurality of process cartridges are loaded, to a mount position, in which the plurality of process cartridges can perform an image forming operation, such that the plurality of process cartridges loaded in the load position are moved to the mount position, and said moving guide being constructed such that when said opening and closing member is opened from a closed state in which said opening and closing member is closed, said moving guide begins to move in interlocking relationship with an opening motion of said opening and closing member after said opening and closing member moves a predetermined amount, and said moving guide is rotated toward the one side of the main body of said apparatus in interlocking relationship with the opening motion of said opening and closing member to move the plurality of process cartridges held by said moving guide to the load position, wherein when the plurality of process cartridges are detached from said moving guide, the plurality of process cartridges are detached through the one side of the main body.

12. An electrophotographic image forming apparatus according to claim 11, further comprising a driving cancellation mechanism for disconnecting drive transmitting means for transmitting drive to the photosensitive drum and to the process means while said opening and closing member moves the predetermined amount.

13. An electrophotographic image forming apparatus according to claim 11, wherein positioning members for positioning the plurality of process cartridges relative to the main body of said apparatus are fixed to the main body of said apparatus.

14. An electrophotographic image forming apparatus according to claim 11, wherein said moving guide comprises an electrical contact member for electrically connecting a first electrical contact provided in each of the plurality of process cartridges to a second electrical contact provided in the main body of said apparatus.

15. An electrophotographic image forming apparatus according to claim 14, wherein said electrical contact member comprises a first electrical contact face for abutting the first electrical contact provided in each of the plurality of process cartridges held by said moving guide, and a second electrical contact face for abutting the second electrical contact provided in the main body of said apparatus, when each of the plurality of process cartridges are moved to the mount position.

* * * * *